US006734377B2

(12) United States Patent
Gremm et al.

(10) Patent No.: US 6,734,377 B2
(45) Date of Patent: May 11, 2004

(54) TOUCH SWITCH LAYOUT AND METHOD FOR THE CONTROL OF A TOUCH SWITCH

(75) Inventors: Oliver Gremm, Kuernbach (DE); Elmar Herweg, Oberderdingen (DE)

(73) Assignee: E.G.O. Elektro-Geraetebau GmbH (DE)

( * ) Notice: Subject to any disclaimer, the term of this patent is extended or adjusted under 35 U.S.C. 154(b) by 29 days.

(21) Appl. No.: 10/140,543

(22) Filed: May 7, 2002

(65) Prior Publication Data

US 2002/0162730 A1 Nov. 7, 2002

(30) Foreign Application Priority Data

May 30, 2001 (DE) ..... 101 27 594
May 7, 2001 (DE) ..... 101 23 640

(51) Int. Cl.[7] ..... H01H 9/00
(52) U.S. Cl. ..... 200/5 R; 200/5 A
(58) Field of Search ..... 200/1 R, 5 R, 200/5 A, 17 R, 18, 600, 512, 511, 308–317; 341/20, 33, 26, 72, 195, 24; 345/168, 173; 219/483–486, 501, 494, 440–445, 506, 508, 509, 448, 505, 453

(56) References Cited

U.S. PATENT DOCUMENTS 4,894,493 A * 1/1990 Smith et al. ..... 200/5 A
5,572,205 A * 11/1996 Caldwell et al. ..... 341/33
5,867,149 A * 2/1999 Jaeger ..... 345/172
5,945,646 A * 8/1999 Miller et al. ..... 200/5 R
6,172,666 B1 * 1/2001 Okura ..... 345/168
6,198,080 B1 3/2001 Rice et al. ..... 219/506

FOREIGN PATENT DOCUMENTS

| | | | |
|---|---|---|---|
| DE | 195 14 261 A1 | 8/1996 | H05B/6/06 |
| DE | 19645907 A1 | 5/1998 | F24C/7/08 |
| DE | 197 06 278 A1 | 8/1998 | F24C/7/08 |
| DE | 19918290 C1 | 1/2001 | F24C/7/08 |
| EP | 0 788 292 A1 | 8/1997 | H05B/3/74 |
| EP | 0 990 855 A2 | 4/2000 | F24C/7/08 |

* cited by examiner

*Primary Examiner*—Michael A. Friedhofer
(74) *Attorney, Agent, or Firm*—Akerman Senterfitt

(57) ABSTRACT

A touch switch layout for a hob having several hotplates is described. For said hotplates is in each case provided a separate selection switch with which the power can be selected in each case. There is also a single, common touch switch for power reduction for all the hotplates. According to the associated operating method, on operating the common power control switch only the power of a selected hotplate is modified or reduced. The power of a hotplate is increased by briefly operating a selection button as selection and renewed operation of the selection button as an increase. This then functions as a power increase switch. It is obvious that the function can also be reversed.

28 Claims, 2 Drawing Sheets

TOUCH SWITCH LAYOUT AND METHOD FOR THE CONTROL OF A TOUCH SWITCH

FIELD OF APPLICATION AND PRIOR ART

The invention relates to a touch switch layout according to the preamble of claim 1. The invention also relates to a method according to the preamble of claim 20. Such touch switch layouts are advantageously used for electrical appliances having several electric loads. The electric loads can be adjusted with regards to their electric power. By means of a selection switch, they can be selected for a power setting or control to be performed.

Such known touch switch layouts have a selection switch for each electric load, as well as a positive and minus button for the power setting. This means that three touch switches are required for each electric load, which is very complicated, also from the standpoint of the control method.

PROBLEM AND SOLUTION

The problem of the invention is to provide a touch switch layout and a control method for electrical appliances having several electric loads, which can be manufactured with less effort and expenditure, whilst ensuring a high operational reliability and safety.

This problem is solved by a touch contact layout having the features of claim 1 and a method having the features of claim 20. Advantageous and preferred further developments of the invention form the subject matter of the further claims and are explained in greater detail hereinafter. By express reference the wording of the claims is made into part of the content of the description.

According to the invention the selection switch can be used for a specific electric load also or simultaneously for a power setting, e.g. in the plus or minus direction. A power setting can take place in such a way that firstly the selection switch is briefly operated in order to select the specific load. By operating the same selection switch again, it is possible to carry out the power change, e.g. in the form of a power increase. Reference should also be made to the following explanation of the method according to the invention. Thus, a maximum of only two switches per load are required. Thus, for the touch switch layout it is possible to economize one switch, which offers considerable advantages during manufacture and with regards to the operational reliability.

In a preferred development of the invention a common setting or control switch can be provided for several electric loads for a power setting in the other direction compared with that of the selection switch. This permits a further reduction in the number of touch switches, namely an individual selection and power control switch for one direction and a common control switch for the power setting in the other direction. Thus, in this case for the specific electric load, apart from the common control switch it is only necessary to provide a single, individual or specific selection switch. This is more particularly preferred for all electric loads of the electrical appliance.

In order to facilitate operation and control, particularly with one hand, the selection switches or the individual switches can be grouped around at least one common control switch. This particularly advantageously takes place in the form of a polygon corresponding to the number of selection switches. A regular polygon is considered advantageous both optically and from the control standpoint. Preferably there is a touch switch in every angle of the polygon. The touch switches should not be too far apart and are advantageously roughly identical. A one-hand operation is possible for an adult at a distance of max 15 cm, a distance of approximately 5 cm being particularly ergonomic. In this case there can be a simultaneous operation of a central control switch and at least one selection switch as a safety lockout against undesired operation.

With the selection switches can be associated optical or visual display means for displaying the status or switching state of the particular electric load. Preferably individual display means are associated with each selection switch. In a further development of the invention the display means can have several different functions, particularly relative to said electric load. These functions can e.g. be a power display, a hot display and/or a programming which has taken place. A difference between different functions can be provided by an activating LED or specific, different display or representation modes of the display means. Possibilities are e.g. a flashing at different frequencies or different brightness stages.

According to a development of the invention, at least two electric loads are operable and can be adjusted with respect to specific criteria, preferably their power. For this purpose the touch switch layout can have at least three touch switches, which are preferably arranged around a central point or area, preferably in a regular or uniform layout. The display means for displaying the load state can then be located in the area within the layout of the touch or contact switches or in the area of said central point. They are advantageously constructed in such a way that the state of several loads can be displayed in alternating form.

It is fundamentally possible with the display means to display the state of several or all the loads. Since preferably for ease of operation in each case only the state of one load is simultaneously displayed, a state display of the loads should take place in alternating manner. Thus, it is a major advantage of the invention that for several loads only a single display means has to be provided and that the costs for further display means are saved. This expenditure saving is considerable, because it is not only possible to economize on the components per se, but also on their fitting and possible control. It also makes it possible to keep the printed circuit boards carrying the layouts smaller and simpler.

The display alternation can on the one hand take place automatically or in automatically following time intervals for the different loads. Advantageously only those loads which are activated are displayed.

Alternatively a display of the state of a specific touch switch can be polled as required or the display thereof adjusted. For this purpose, e.g. by a single operation of the touch switch individual to each load there can be a change to the display of the state of said load.

According to an embodiment of the invention a control for a hob with several, in particular four hotplates can be created. At a central point or area can be provided a common power control switch and alongside the same a LED display. In a substantially rectangular arrangement about said central point, selection switches can be provided for each of the hotplates. These selection switches have a complimentary function to the common power control switch. If e.g. with the common power control switch the power can be decreased, then with the individual selection switch it can be increased as a power control function and vice versa.

An indication of the particular touch switches or loads for which the central display means are at present active can advantageously take place by means of a display associated with the individual touch switch. In a simple form this can e.g. be a LED. It is possible to use it by different luminous intensities or possible flashing frequencies, both as a general active display and as a selection display for the particular touch switch or the associated load.

In a simple embodiment the display means can have at least one filament lamp or LED. There are preferably several LEDs juxtaposed in line, bar or circular arc form.

Alternatively or additionally the display means can have a seven-segment display. With such an alphanumeric display figures and most letters can be displayed in a clear and readily readable form, so that more information can be displayed.

The method according to the invention for the control of a touch switch provides for the selection of the electric load by a single contact of the touch switch or sensor surface. By contacting again the electric power can be set in a specific direction, so that an easy operation of the touch switch or setting of the electrical appliance load can take place.

In the other direction the power or a similar characteristic of the electric load can be adjusted by a further touch switch. This further touch switch does not necessarily require a selection function, so that the means can be rendered more simple.

Preferably there is a touch switch for the power setting in the other direction jointly for several loads. For a particular power setting in each case one load can be selected by the selection switch and then the power can be adjusted.

The switching in of an additional load associated with the selected load in a hotplate of an electric hob, e.g. an additional heater, can take place by setting the highest power stage for said load. Conventionally such additional heaters are constructed as two-circuit heaters. This is followed by a further raising of the electric power by operating the corresponding touch switch, so that the additional load is activated. A deactivation can be brought about by power reduction or by completely switching off the load.

These and further features can be gathered from the claims, description and drawings and the individual features, either singly or in the form of subcombinations, can be implemented in an embodiment of the invention and in other fields and can represent advantageous, independently protectable constructions for which protection is claimed here. The subdivision of the application into individual sections and the subtitles in no way restrict the general validity of the statements made thereunder.

BRIEF DESCRIPTION OF THE DRAWINGS

An embodiment of the invention is described hereinafter relative to the attached drawings, wherein show.

DETAILED DESCRIPTION OF THE EMBODIMENTS

Figure 1:
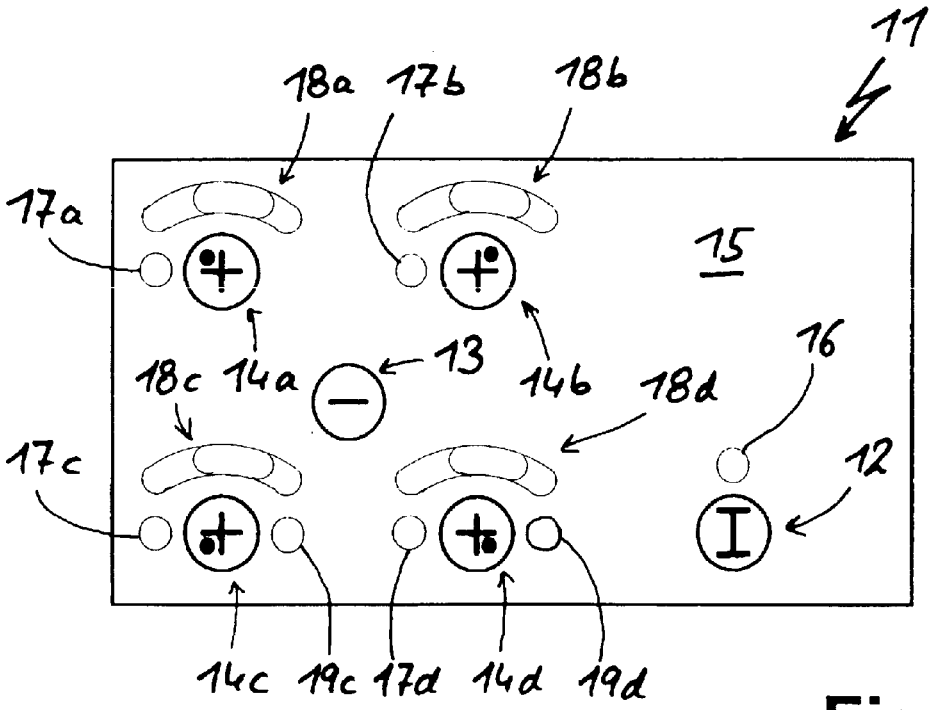
FIG. 1 A diagrammatic representation of a touch switch layout according to the invention for a hob having four hotplates.
Figure 2:
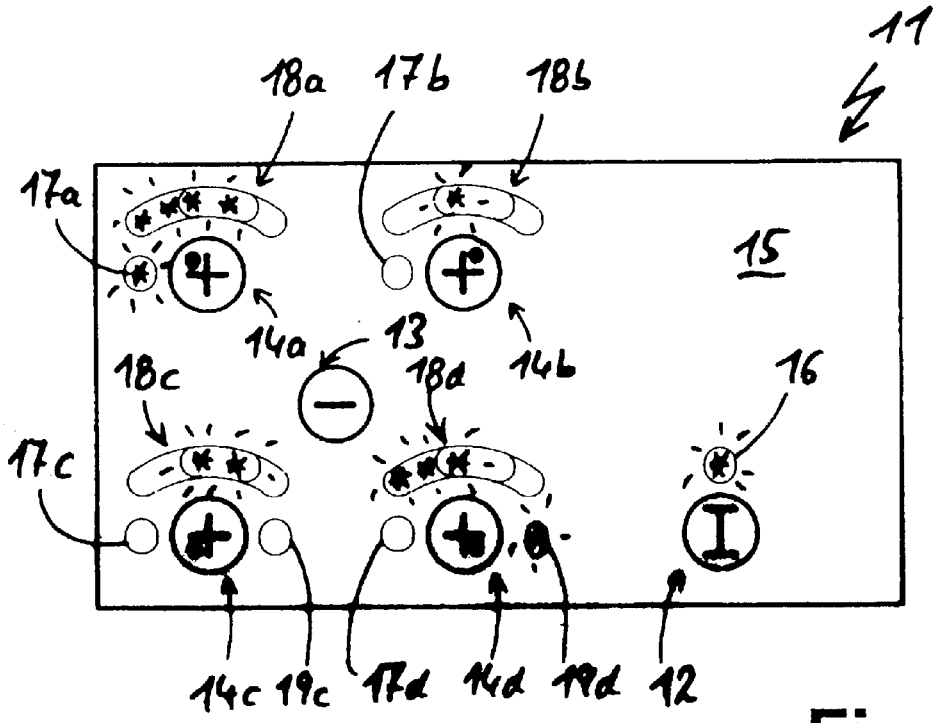
FIG. 2 The layout of FIG. 1 in an operating state.

FIG. 1 shows a touch switch layout 11, which is shown in the operated state in FIG. 2. It has several touch switches, namely an on-off switch 12, a central minus or negative switch 13 and four selection/plus or positive switches 14*a–d* grouped around the negative switch 13. The individual touch switches 12 to 14*a–d* are represented by corresponding, imprinted decoration on the top of a contact or touch surface 15. In exemplified manner this is provided in an area of the glass ceramic hob, which is provided with imprints. These selection and positive switches 14*a–d* represent the four hot points of the hob, which is shown by the dot relative to the cross or plus sign.

An on-off switch 12 has an activatable LED 16, which lights up when the hob is switched on. No display is associated with the central negative switch 13. Display means in the form of a selection LED 17*a–d* and bar LED displays 18*a–d* arranged in circular arc form are associated with the individual selection switches. As is indicated by the thin lines, which can be printed-on decoration, they are subdivided into three areas.

To the right the selection switches 14*c* and 14*d* additionally have a two-circuit LED 19*c* and 19*d* showing an activated two-circuit or additional heater for the particular hotplate. Such two-circuit heaters are e.g. known as an extended cooking or heating zone.

The touch switches can be conventional touch switches, i.e. optical, capacitive, etc. The touch switches can have a contact-sensitive sensor surface. Capacitive touch switches with their control, as are e.g. described in EP 859 468, are used in a preferred manner.

Figure 3:
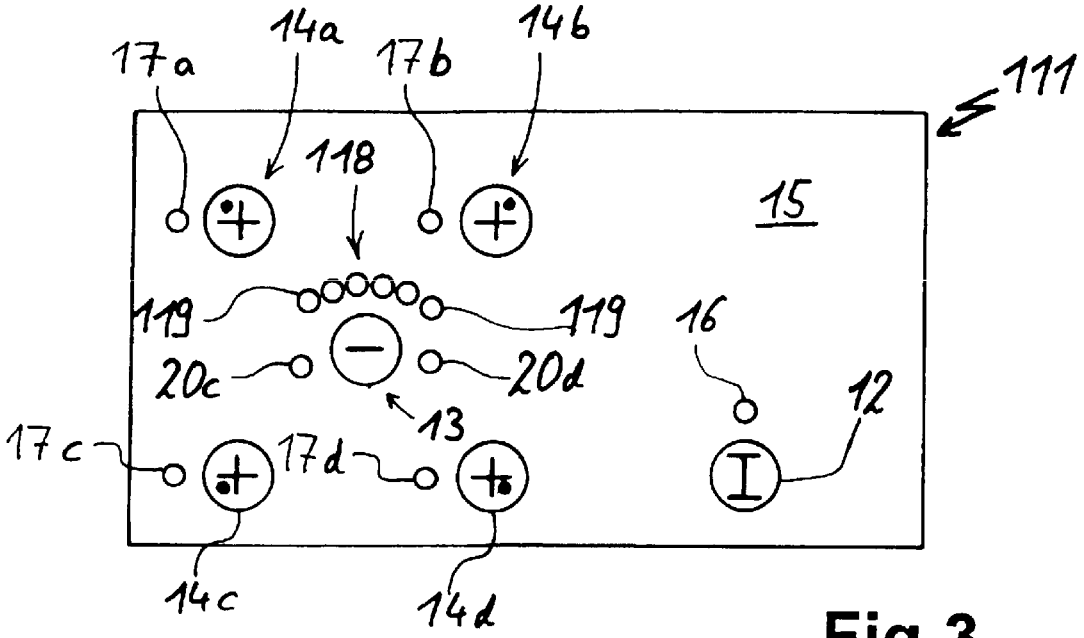
FIG. 3 Another diagrammatic representation of a touch switch layout with the general function.

FIG. 3 shows a further exemplified touch switch layout 111 similar to that of FIG. 1. It is shown in the operated state in FIG. 4 and is located on a contact surface 15. The latter area is provided with imprints. The layout 111 has several touch switches, namely an on-off switch 12 as in FIG. 1, a central minus or negative switch 13 and four selection/plus or positive switches 14*a–d* grouped around the negative switch 13. The individual touch switches 12 to 14*a–d* are once again represented by corresponding printed-on decoration on the top of the contact surface 15.

In a variant of this embodiment the positive and negative switches can be interchanged and then there would be a central positive switch.

A display 118 as the display means is associated with the central negative switch 13 within the switch layout 14. This central display 118 comprises six LEDs 119 arranged in an arc. The LEDs 119 can be individually controlled in a random manner. They are advantageously also modifiable with respect to their brightness or can be operated in a flashing manner. In the central area to the left and right of the negative switch 13 is provided in each case a two-circuit LED 20*c* and 20*d*, which are used for displaying in switched on form additional two-circuit heaters of the hotplates belonging to the switches 14*c* and 14*d* in a known manner.

In addition, a selection LED 17*a–d* is associated with each selection/positive switch 14*a–d*. Said selection LEDs indicate whether the hotplate associated with the given touch switch 14 is activated.

The touch switches can be conventional touch switches, i.e. optical, capacitive, etc. Particularly advantageous capacitive touch switches, together with their control are e.g. described in EP 859 468, to which express reference is hereby made.

Function

A method for the operation or control of the touch switch layout 11 or the hob controlled therewith can be in the following form. Firstly the on-off switch 12 is operated by contact or finger application. Then by operating a random selection switch 14 a hotplate can be selected, which means that it is subsequently ready for a power setting or control. By further operation of the given selection switch 14, which now functions as a positive switch, the hotplate power is increased in stages. In the layout according to FIGS. 1 and 2 five stages exist. It is also possible to have a finer subdivision or gradation. This can be indicated by a number of LEDs corresponding to the heating stages. A further possibility is the gradation of the brightness of the individual LEDs up to the highest level or a flashing operation.

By continued application to the touch switch for a few seconds, it is also possible to pass automatically from the function of the selection switch to that of the positive switch.

After the power setting has taken place or directly after reaching the first power stage, the control means of the touch switch arrangement 11 activates the corresponding heater. With the operation of the selection switch 14 the associated selection LED 17 is activated and lights up.

In the case of the selection/positive switches 14*c* and *d* with an associated two-circuit heater, the highest power stage is set to activate said heater. By operating the positive switch again, the control recognizes this "overswitching" as a tripping of the two-circuit heater and activates the same correspondingly. This activation is indicated by a lighting up of the corresponding two-circuit LED 19.

A power reduction takes place by the above-described selection of a hotplate. By corresponding operation of the central negative switch 13, the power can be reduced in the same way as on increasing the same. On reaching the power stage zero, the heater is deactivated or switched off. The corresponding hotplate continues to be selected. In this way it is e.g. also possible to switch off a two-circuit heater.

An increase and a decrease of the power can either take place by a corresponding number of operations or switching processes on the touch switch, or there can be a continuous running on by continued operation or finger application to the touch switch.

The switching state of the four hotplates in FIG. 2 is as follows. The hotplate associated with the selection switch 14*a* is selected, cf. the illuminated selection LED 17*a*. The power stage 4 is set and this is represented by the four illuminated LEDs of the bar LED display 18*a*.

In the case of the hotplate associated with the switch 14*b*, the corresponding display 18*b* functions as a hot display and indicates the state of a stage 1, i.e. still a residual heat. The hotplate is not selected.

In the case of the hotplate of the selection switch 14*c*, the hot display of display 18*c* is on the second and therefore higher stage. In this way a user is informed of a different residual heat of the hotplate via gradable hot displays. There can be an even finer gradation through several LEDs provided for this purpose or different display types.

The hotplate of the selection switch 14*d* is not selected, but is activated, namely to power stage 3. The illuminated two-circuit LED 19*d* indicates that the two-circuit heater is switched on.

An advantageous method for the operation or control of a touch switch layout 111 according to FIG. 3 or a hob controlled by it and which is constructed correspondingly with the exception of the central display has been described hereinbefore. As a variant the present invention has a central display, whose function will be explained hereinafter.

Figure 4:
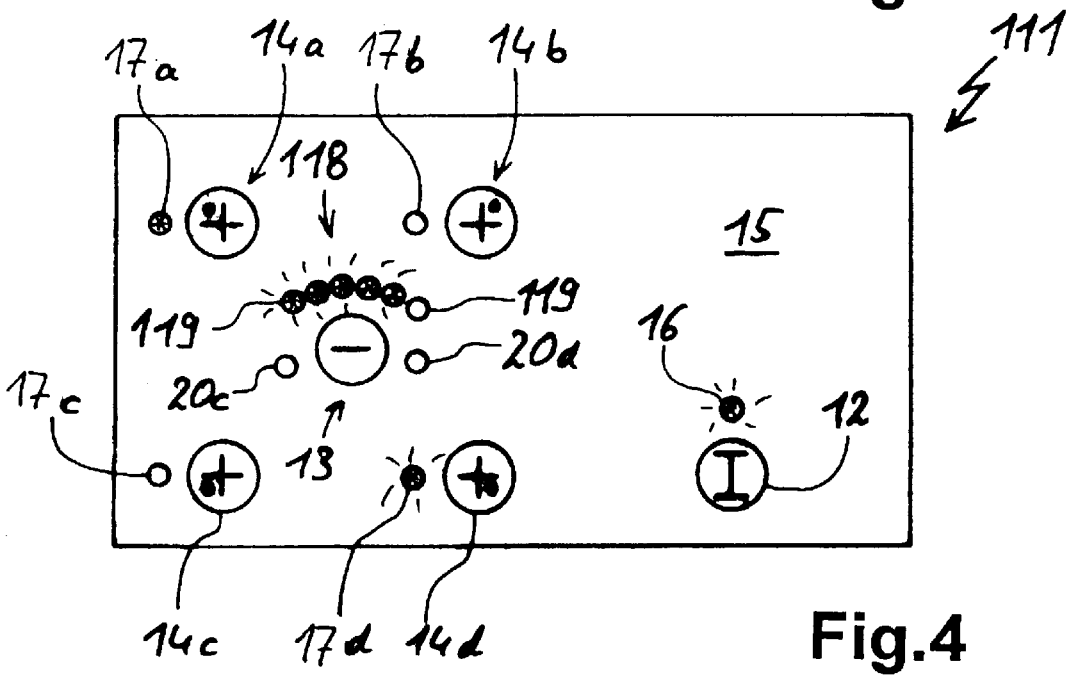
FIG. 4 The touch switch layout of FIG. 3 in an operating state.

In FIG. 4 the LED 16 indicates that the touch switch layout 111 or a hob controlled by it is in operation. The selection LED 17*a* of the left-hand, upper hotplate or the selection/positive switch 14*a* is weakly illuminated, which indicates that this hotplate is in operation. The hotplates to the top right and bottom left are not in operation.

The bottom right hotplate belonging to the selection switch 14*d* has the selection LED 17*d* in a very brightly illuminated state and this is represented by the additional lines. In this embodiment this means that the hotplate 14*d* is in operation and the central display 18 displays the state of this hotplate.

The first five LEDs of the central display 111 starting from the left are brightly illuminated. In a simple case this means that the stage 5 of six possible stages is set, in FIG. 2 relative to the hotplate of the selection switch 14*d*. The two-circuit LEDs 20*c* and 20*d* are not illuminated. This makes it clear that a two-circuit heater belonging to the selection switch 14*d* is not activated. Possibilities for the activation of said two-circuit heater were described hereinbefore.

This shows and explains that in FIG. 4, as is apparent from the very brightly illuminated selection LED 17*d* of the bottom right hotplate, the display 118 displays the state of this hotplate. A change of the display 118 to the state of another hotplate or another activated hotplate, e.g. the top left hotplate, is possible either automatically with a specific time interval or manually.

A manual change can take place in simple manner in that the touch switch 14*a* is operated in its capacity as a selection switch. It always has this selection switch function before the first operation. Therefore the control of the touch switch layout 111 changes over to the state of this hotplate and indicates it with the display 118. Simultaneously the selection 17*a* changes from the normal bright to the very bright state, in order to indicate the selection of this hotplate with respect to the display 118. Conversely the selection LED 17*d* changes from the very bright to the normal or less bright state, which indicates that although the associated hotplate is active, its state is not yet shown by the display 118.

In the same sense as described hereinbefore it is possible to construct the display for all four activated hotplates.

It is also possible to use different display possibilities of LEDs, e.g. different brightness stages or a flashing at different frequencies. These possibilities can advantageously be combined with the invention.

As a variant of the touch switch layout 11 or 111 described, the functions of the selection/positive switches 14*a–d* and the central negative switch 13 can be interchanged. In this case there is a central positive switch and individual selection and negative switches. For ease of operation reasons, it is more appropriate when activating a hotplate, which is to take place as simply and rapidly as possible, to combine the selection function with the positive function. It is clear that such a touch switch layout can be advantageously combined with known touch switch layouts or control methods.

In order to increase operational reliability and safety, a selection of a particular hotplate can be automatically stopped after a few seconds. This ensures that e.g. after several minutes there is no change to the switching state of a switch belonging to the particular hotplate as a result of unintentional operation. For example, the selection valid for a particular hotplate can be automatically stopped after 5 to 10 seconds. The selected state is maintained. The selection LED 17 then stops lighting up.

Childproofing or the like can be implemented by simultaneous operation of several, preferably two touch switches. It is conceivable to simultaneously operate the on-off switch and the central negative switch. An activated childproofing means can be indicated by the flashing of the on-off LED 16. A deactivation of the childproofing means is also possible via the simultaneous operation of the two switches.

Alternatively a childproofing means can be activated by the operation of a negative switch 13 if no hotplate is selected. However, it is then necessary to wait for the automatic resetting of the selection of the hotplate, because with such a concept there is no possibility of a manual resetting of the selection. A further activation and deactivation possibility is the operation of the negative switch at the same time as a selection switch.

Thus, in an embodiment of the present invention a touch switch arrangement can be created for a hob having several hotplates. For each of these hotplates a separate selection switch is provided with which the power can be increased. There is also a single, common touch switch for the power reduction of all the hotplates. The separate selection touches can be arranged in a regular polygon and the common touch switch is located in the centre. According to the associated method according to the invention, on operating the common power setting switch only the power of a selected hotplate is modified or reduced. The increase of the power of a hotplate takes place by the brief operation of a selection switch as a selection and renewed operation thereof as an increase and it then functions as a power increase switch. Obviously the function can also be reversed.

In the vicinity of said negative switch and in the area between the selection switches can be provided a display with several arcuately arranged LEDs. The display can show the state of several hotplates in alternating form and advantageously only the state of a single hotplate is shown at any instant. A display change to the other hotplate can take place by a single operation of the selection switch.

What is claimed is:

1. A touch switch layout for an electrical appliance with several electric loads, electric power to said several electric loads being settable by a power setting in a direction towards higher power or lower power, the touch switch layout comprising:

at least one selection switch with a selection function for selecting at least one of said electric loads for said power setting to be carried out, wherein, in addition to said selection function, said at least one selection switch is constructed for said power setting of a specific one of said electric loads in a single direction.

2. Touch switch layout according to claim 1, wherein a common control switch for several of said electric loads is provided for said power setting in the other direction.

3. Touch switch layout according to claim 2, comprising a plurality of said selection switches, wherein said plurality of selection switches are grouped around at least one common control switch.

4. Touch switch layout according to claim 3, wherein a spacing between one of said selection switches and said control switch is less than 10 cm.

5. Touch switch layout according to claim 1, comprising a plurality of said selection switches, wherein said plurality of selection switches are grouped around at least one display.

6. Touch switch layout according to claim 1, comprising a plurality of said selection switches, wherein said plurality of selection switches are arranged to form a polygon, one of said selection switches being located in each angle of the polygon.

7. Touch switch layout according to claim 1, wherein optical display means for a display of a status or switching state of said at least one selection switch are associated with said at least one selection switch.

8. Touch switch layout according to claim 7, comprising a plurality of said selection switches, wherein individual display means for a display of a status or switching state are associated with each of said selection switches, said display means having several functions.

9. Touch switch layout according to claim 7, comprising at least three of said selection switches, at least two of said at least three selection switches being regularly arranged about a central point, said display means being located in an area within said touch switch layout and a state of said several electric loads being displayed in alternating manner by said display means.

10. Touch switch layout according to claim 9, wherein said display means at a particular time statically only displays a state of one of said electric loads and by switching over said display means or by selecting another one of said electric loads, a state of another one of said electric loads is displayable.

11. Touch switch layout according to claim 9, wherein said display means are constructed for displaying several different states of at least one of said electric loads.

12. Touch switch layout according to claim 11, wherein said different states of said at least one electric load displayed by said display means include at least one of a level of electric power of said electric load and a level of residual heat existing in said electric load when said electric loads comprise electric heating appliances.

13. Touch switch layout according to claim 7, wherein the functions of said display means in an electric hob are a power display and a heating display for individual hotplates, the display of the different functions taking place through a selection LED.

14. Touch switch layout according to claim 13, wherein said display of said function differences takes place by specific, different display modes of said display means.

15. Touch switch layout according to claim 7, wherein said display means comprise at least one LED.

16. Touch switch layout according to claim 15, wherein said display means have a bar-like display with several of said LEDs.

17. Touch switch layout according to claim 7, wherein said display means have a seven-segment display for alphanumeric display purposes.

18. Touch switch layout according to claim 1, wherein the touch switch layout is constructed for control of a hob having several hotplates, wherein a common control switch for the power and a LED display are provided in a central area of the touch switch layout and one of said selection switches is provided for each of said hotplates in a regular arrangement around said central area, each selection switch having a complimentary power setting function.

19. Touch switch layout according to claim 18, wherein a further LED as an active display is associated with each said selection switch provided for each of said hotplates.

20. A method for the control of at least one touch switch for an electrical appliance with at least one electric load, electric power of an electric load being settable by a power setting in a direction towards higher power or lower power, the method comprising the steps of:

by a single operation of a touch switch, selecting an electric load and, by a further operation of said touch switch, setting the electric power of the selected electric load in a single direction.

21. Method according to claim 20, wherein the power of the selected electric load is set in the other direction by a further touch switch.

22. Method according to claim 21, wherein the further touch switch is without a selection function.

23. Method according to claim 21, wherein the touch switch for setting the electric power in the other direction is provided as a common touch switch for several of the electric loads.

24. Method according to claim 23, wherein the selection of the selected electric load is carried out prior to the operation of the common touch switch and setting the power setting.

25. Method according to claim 20, wherein a plurality of touch switches are provided, and wherein a protection against unintentional or unauthorized operation is provided by a necessarily combined operation of at least two of the touch switches simultaneously.

26. Method according to claim 20, wherein a plurality of touch switches are provided, and wherein a protection against unintentional or unauthorized operation is provided by a necessarily combined operation of ax least two of the touch switches successively.

27. Method according to claim 20, wherein the selected electric load is with an additional electric load, a switching in of the additional electric load being associated with the selected electric load taking place by setting a highest power setting for the selected electric load and a subsequent setting of an even higher power stage.

28. Method according to claim 20, wherein the touch switch comprises a contact-sensitive sensor surface.

* * * * *